US007261990B2

(12) United States Patent
Matsuzaki

(10) Patent No.: US 7,261,990 B2
(45) **Date of Patent: *Aug. 28, 2007**

(54) TONER PARTICLES FOR IMAGE FORMING APPARATUS

(75) Inventor: Koichi Matsuzaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/351,643

(22) Filed: Feb. 10, 2006

(65) Prior Publication Data

US 2006/0127792 A1 Jun. 15, 2006

Related U.S. Application Data

(62) Division of application No. 10/838,817, filed on May 4, 2004, now Pat. No. 7,099,610.

(30) Foreign Application Priority Data

May 14, 2003 (JP) ..... 2003-135993

(51) Int. Cl.
*G03G 9/00* (2006.01)

(52) U.S. Cl. ..... 430/111.4

(58) Field of Classification Search ..... 430/111.4
See application file for complete search history.

(56) References Cited

U.S. PATENT DOCUMENTS 5,614,348 A * 3/1997 Inoue et al. ..... 430/111.41
6,638,632 B2 10/2003 Ohuchi et al.
2002/0106574 A1 8/2002 Haneda et al.
2005/0002701 A1 1/2005 Ikeguchi et al.

FOREIGN PATENT DOCUMENTS

JP 06-194943 A 7/1994
JP 08-44209 A 2/1996
JP 08-106170 A 4/1996
JP 08-179606 A 7/1996
JP 09-197713 A 7/1997
JP 10-186712 A 7/1998

(Continued)

OTHER PUBLICATIONS machine translation of JP 10-186712.*

*Primary Examiner*—Mark A. Chapman
(74) *Attorney, Agent, or Firm*—Akin Gump Strauss Hauer & Feld LLP

(57) ABSTRACT

An image forming apparatus includes an image bearing body and a developing section. An electrostatic latent image is formed on the image bearing body. The developing section includes a developing member and a toner supplying member. The developing member is in contact with the image bearing body and applies toner to the electrostatic latent image. The toner supplying member is in contact with the developing member and has a peripheral surface that moves relative to the developing member. The toner has substantially spherical particles and is supplied from above the developing section and has a saturated apparent density not more than 0.4217 g/ml. The amount of the toner deposited on the developing member is in the range of 0.5 to 1.0 mg/cm2. The layer of the toner deposited on the developing member has a surface potential in the range of −50 to −250 V.

16 Claims, 1 Drawing Sheet

FOREIGN PATENT DOCUMENTS

| | | | |
|---|---|---|---|
| JP | 11-119547 | A | 4/1999 |
| JP | 11-174732 | A | 7/1999 |
| JP | 11-212327 | A | 8/1999 |
| JP | 11-242352 | A | 9/1999 |
| JP | 2000-305343 | A | 11/2000 |
| JP | 2000-315014 | A | 11/2000 |
| JP | 2001-265115 | A | 9/2001 |
| JP | 2002-055516 | A | 2/2002 |
| JP | 2002-258612 | A | 9/2002 |
| JP | 2003-5434 | A | 1/2003 |
| WO | WO97-01131 | A1 | 1/1997 |

* cited by examiner

TONER PARTICLES FOR IMAGE FORMING APPARATUS

CROSS-REFERENCE TO RELATED APPLICATIONS

This application is a Divisional of U.S. patent application Ser. No. 10/838,817, filed May 4, 2004 now U.S. Pat. No. 7,099,610, the disclosure of which is incorporated herein by reference.

BACKGROUND OF THE INVENTION

The present invention generally relates to an image drum cartridge and a developing unit.

A conventional image forming apparatus such as a printer, a copying machine, and a facsimile machine utilizes an electrophotographic process. A surface of a photoconductive drum covered with a photoconductive insulating layer is charged uniformly. Then, the charged surface is exposed to a light image that represents print data. The light image selectively dissipates the charges on the surface of the photoconductive drum to form an electrostatic latent image on the surface of the photoconductive drum. Then, the electrostatic latent image is developed with a developer material (e.g., toner) containing a coloring agent into a toner image. The toner image is transferred onto print paper and subsequently fused under pressure and heat into a permanent image.

With a conventional image forming apparatus, when printing is performed in a low-duty mode intermittently in a low-temperature and low-humidity environment, the printed images are soiled. For example, if only a few lines of characters are printed on A4 size paper in an environment of 10° C. and 20% RH at a rate of one page per five minutes, the printed images becomes significantly soiled one to two hours after printing is initiated.

FIG. 2 illustrates a pertinent portion of a conventional developing unit.

Referring to FIG. 2, a developing roller 14 rotates in contact with a photoconductive drum 21 in a direction shown by arrow A, thereby applying toner to the photoconductive drum 21. A sponge roller 13 rotates in contact with the developing roller 14 in a direction shown by arrow B, thereby supplying toner to the developing roller 14. A developing blade 15 forms a thin layer of toner on the developing roller 14.

A good rule of thumb is that a printed image is soiled if the following relation is met, $$(Vdv+Et)-EOPC<C \quad \text{Eq. (1)}$$

where EOPC is the surface potential of the photoconductive drum 21, Vdv is the voltage applied to the developing roller 14, Et is the surface potential of toner that forms a toner layer, and C is a constant unique to that electrophotographic printer.

This relation is due to the following fact. Actually, the toner layer on the developing roller 14 is not uniformly charged to a surface potential Et but with a certain distribution of charges. In other words, Et is an only average of the distributed charges. Thus, excessively charged toner particles may adhere to non-exposed areas on the photoconductive drum 21, causing soiling of printed images.

For example, in a low-temperature and low-humidity environment, if EOPC≈−800 V, Vdv=−220 V, and C=250, then Eq. (1) gives the following relation.

$$(Vdv+Et)EOPC=(-220+Et)-(-800)<250$$

Therefore, Et<−330 V. This shows that values of Et<−330 V causes toner to be negatively charged excessively to give rise to soiling of printed images.

In a low-temperature and low-humidity environment, a charging roller 19 becomes dry to have a high electrical resistance, but receives the same constant voltage for charging the photoconductive drum 21. This causes a decrease in current injected into the photoconductive drum 21, so that the surface potential EOPC will increase correspondingly toward zero volts. The toner will also become dry to have a high electrical resistance, so that the toner is easily charged and the surface potential Et will be more negative.

When intermittent low-duty printing is performed, the toner that falls from a toner cartridge, not shown, becomes dense, especially on a portion P1 slightly upstream of the developing blade 15 with respect to the direction of rotation of the developing roller 14.

This phenomenon takes the form of a change in apparent density of toner with time. The apparent density is calculated by measuring the volume of the pile of toner a certain length of time after an amount of toner is introduced into a container. When toner is put in a container and left as it is, the toner is packed slowly to decrease in volume. As a result, the apparent density of the toner changes (usually increases). Table 1 lists apparent densities of pulverized toner and polymer toner.

TABLE 1

| | time (min) | | | | | | | | |
|---|---|---|---|---|---|---|---|---|---|
| | 0 | 0.5 | 1 | 2 | 3 | 4 | 5 | 6 | 10 |
| pulverized toner | 0.3061 | 0.3082 | 0.3095 | 0.3103 | 0.3103 | 0.3103 | 0.3103 | 0.3103 | 0.3103 |
| polymer toner | 0.4125 | 0.4409 | 0.4614 | 0.4896 | 0.5054 | 0.5110 | 0.5110 | 0.5138 | 0.5138 |

The apparent densities were calculated based on the volume of toner. A mixture of 30 grams pulverized toner and 30 grams polymer toner was agitated for 30 seconds and then put into a graduated cylinder of a 100-mi capacity. The toner in the graduated cylinder is left as it is for a certain time length without adding mechanical vibration. The apparent density is expressed in g/ml. As is clear from Table 1, the apparent density of pulverized toner does not change significantly but the apparent density of polymer toner increases with time until it substantially saturates after six minutes. The apparent density at this situation is referred to as saturated apparent density. The pulverized toner is manufactured by mechanically pulverizing and therefore the toner particles are in a variety of irregular shapes. Thus, nonuniform shapes of toner particles prevent the toner particles from being packed when the toner particles are left as they are. On the other hand, the particles of the polymer toner are uniform in size and generally spherical in shape, and therefore are apt to be packed when the particles are left as they are. In other words, the more spherical the toner particles are, the more easily the toner particles are packed.

Larger apparent densities cause a thicker toner layer on the developing roller 14 and a more negative surface potential Et.

As described above, performing low-duty printing in a low-temperature and low-humidity environment causes soiling of printed images and hence poor print quality.

BRIEF SUMMARY OF THE INVENTION

An object of the invention is to solve the problems associated with the aforementioned conventional image forming apparatus.

Another object of the invention is to provide an image forming apparatus in which when low-duty printing is performed in a low-temperature and low-humidity environment, printed images are not soiled so that quality images can be obtained.

An image forming apparatus includes an image bearing body on which an electrostatic latent image is formed, and a developing section in which the electrostatic latent image is developed into a visible image. The developing section includes a developing member and a toner supplying member. The developing member is in contact with the image bearing body and applies toner to the electrostatic latent image. The toner supplying member is in contact with the developing member and has a peripheral surface that moves relative to the developing member.

The toner has substantially spherical particles and is supplied from above the developing section and has a saturated apparent density not more than 0.4217 g/ml.

The amount of the toner deposited on the developing member is in the range of 0.5 to 1.0 mg/cm$^2$.

The layer of the toner deposited on the developing member has a surface potential in the range of −50 to −250 V.

The amount of the toner deposited on the image bearing body is in the range of 0.4 to 0.8 mg/cm$^2$.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Embodiments of the present invention will be described in detail with reference to the drawings. By way of example, the embodiments will be described with respect to an electrophotographic printer as an image forming apparatus.

First Embodiment

{Construction of Image Forming Apparatus}

Figure 1:
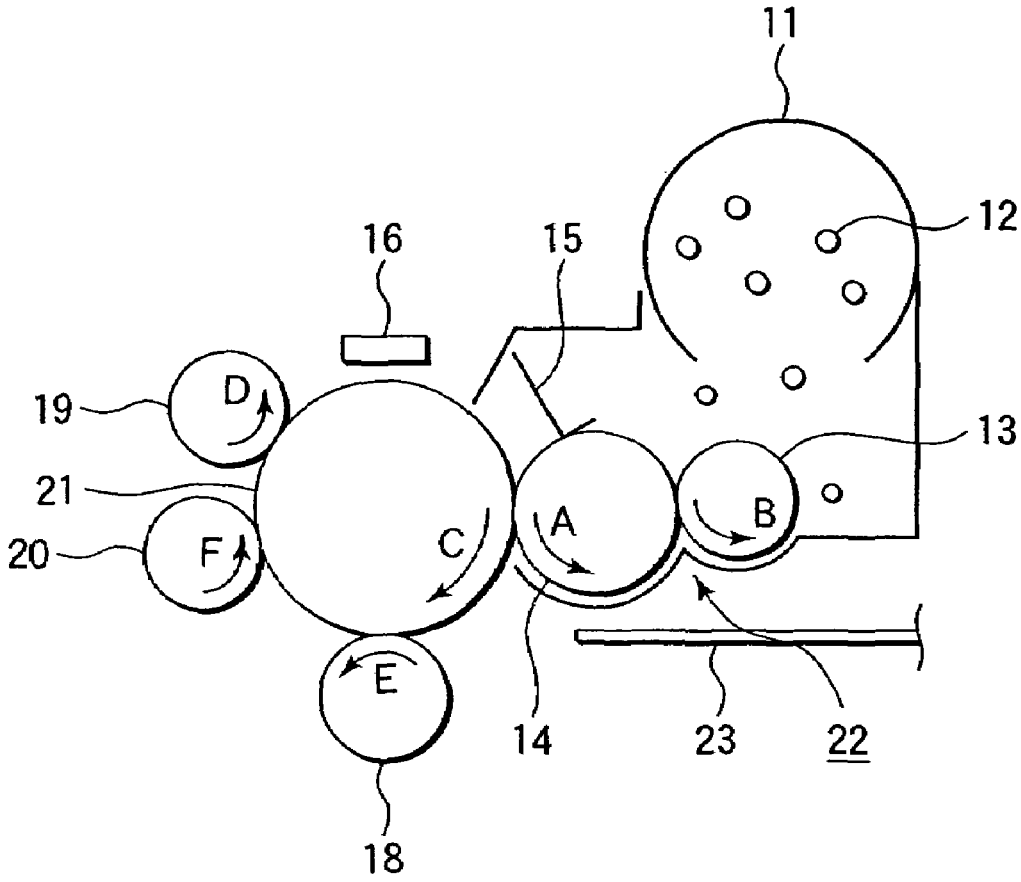
FIG. 1 illustrates a general configuration of an electrophotographic printer according to an embodiment of the invention.
Figure 2:
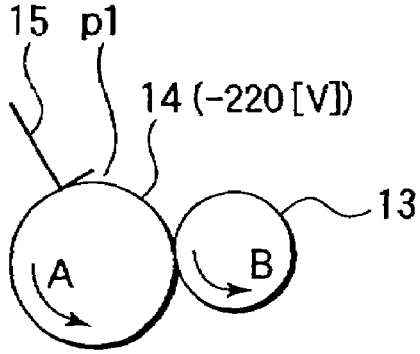
FIG. 2 illustrates a pertinent portion of a conventional developing unit.

FIG. 1 illustrates a general configuration of an electrophotographic printer according to embodiments of the invention.

Referring to FIG. 1, a photoconductive drum 21 is covered with a photoconductive insulating material and rotates in a direction shown by arrow C. A charging roller 19 rotates in contact with the photoconductive drum 21 in a direction shown by arrow D. The charging roller 19 receives a high voltage of −1350 V and charges the surface of the photoconductive drum 21 to a uniform potential. An LED head 16 illuminates the charged surface of the photoconductive drum 21 in accordance with print data, thereby forming an electrostatic latent image on the photoconductive drum 21.

Subsequently, a developing unit 22 develops the electrostatic latent image with toner into a toner image. The developing unit 22 includes a developing roller 14, a sponge roller 13, a developing blade 15, and a toner cartridge 11. The developing roller 14 rotates in contact with the photoconductive drum 21 in a direction shown by arrow A. The sponge roller 13 is formed of a resilient material and rotates in contact with the developing roller 14 in a direction shown by arrow B. The developing blade 15 forms a thin layer of toner on the surface of the developing roller 14. The toner cartridge 11 holds toner therein. The sponge roller 13 rotates in the toner 12 that was supplied from the toner cartridge 11. The sponge roller 13 and the developing roller 14 rotate in the same direction, so that their contact surface areas run in opposite directions to each other.

The developing roller 14 applies the toner 12 in a thin layer, formed by the developing blade 15, to the electrostatic latent image formed on the photoconductive drum 21, thereby forming a toner image.

A transfer roller 18 rotates in contact with the photoconductive drum 21 in a direction shown by arrow E. Thus, the transfer roller 18 transfers the toner image onto paper 23. Thereafter, the paper 23 advances to a fixing unit, not shown, where the toner image is fused under pressure and heat into a permanent image. A cleaning roller 20 rotates in contact with the photoconductive drum 21 in a direction shown by arrow F to scrape the residual toner 12 on the photoconductive drum 21 after transferring.

When a motor, not shown, is driven in rotation, the rotation of the motor is transmitted to the photoconductive drum 21. Then, the rotation is further transmitted through gears, not shown, from the photoconductive drum 21 to the charging roller 13, transfer roller 18, and cleaning roller 20. A power supply, not shown, applies voltages to the photoconductive drum 21, charging roller 19, developing roller 14, sponge roller 13, transfer roller 18, and cleaning roller 20. A controller, not shown, controls these voltages.

The developing blade 15 is formed by bending a 0.2 mm-thick stainless steel sheet into a substantially L-shape. The outer curved portion of the developing blade 15 is pressed against the developing roller 14 under a predetermined pressure.

The developing roller has a resilient roller portion formed of a resilient material such as a silicone rubber and a urethane rubber which contain an electrically conductive material, so that the roller portion is semiconductive (electrical resistance shown in Table 2). For controlling the ability of the developing roller 14 to carry toner and cause the toner to be charged, the surface of the resilient portion is polished, subjected to surface treatment such blast treatment, or coated with a resin. In the present invention, the developing roller 14 is coated with an amino silane coupling agent.

TABLE 2

| Rolling member | Material: shafts | Material: Resilient roller | Electrical resistance Ω | Hardness |
|---|---|---|---|---|
| Charging roller | metal | epichlorohydrin rubber | $9 \times 10^7$ to $2.5 \times 10^8$ | |
| Developing roller | | semiconductive silicone rubber | $6 \times 10^8$ to $5 \times 10^9$ | "ASKER C" at 55–65° C. |
| Sponge roller | | semiconductive foamed silicone rubber | $7 \times 10^7$ to $5 \times 10^8$ | "ASKER F" at 55–65° C. |

The toner 12 is of a spherical capsule structure. The toner 12 is formed of more than two types of resins that have different glass points. The toner 12 has saturated apparent density of not more than 0.4217 g/ml.

{Method of Manufacturing Toner}

The method of manufacturing the toner 12 according to the present invention will now be described in detail.

Resin materials that form the core and shell for toner 12 include thermoplastic resins such as vinyl resin, polyamide resin, and polyester resin. The following compositions can be used as a monomer that constitutes vinyl resin for some of the thermal plastic resins: styrene, styrene or styrene derivatives, ethylenic monocarboxylic acid and its esters, ethylenic unsaturated monoolefins, ethylenic monocarboxylic acid substitution and its esters, and ethylenic dicarboxylic acid such as maleic acid and its substituted compounds.

The aforementioned styrene derivatives include styrene, 2,4-dimethylstyrene, α-methystyrene, p-ethylstyrene, o-methylstyrene, m-methylstyrene, p-methylstyrene, p-clorostyrene, and vinyl naphthalene.

The aforementioned ethylenic monocarboxylic aced and its esters include 2-ethylhexyl acrylate, methyl methacrylate, acrylic acids, methyl acrylate, ethyl acrylate, n-propyl acrylate, isobutyl acrylate, acrylic-t-butyl, amyl acrylate, cyclohexyl acrylate, acrylic acid-n-octyl, isooctyl acrylate, decylacrylate, lauryl acrylate, stearyl acrylate, methoxyethyl acrylate, 2-hydroxyethyl acrylate, glycidyl acryalte, phenyl acrylate, α-chloromethyl acrylate, methacrylic acid, ethyl methacrylate, n-propyl methacrylate, isopropyl methacrylate, n-butyl methacrylate, isobutyl, ethacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, hydroxyethyl-2-methacrylate, hydroxyethyl-2-methacrylate, glycidyl methacrrylate, phenyl methacrylate, and diethylaminoethyl methyacrylate.

The aforementioned ethylenic unsaturated monoolefins include ethylene, propylene, butylene, and isobutylene.

The aforementioned vinyl esters include vinyl chloride, vinyl bromoacetate, vinyl propionate, vinyl formate, and vinyl caprorate.

The aforementioned ethylenic monocarboxylic acids and their substitution include acrylate nitrile, methacrylonitrile, and acrylamide.

The aforementioned ethylenic dicarboxylic acids including, for example, maleate may be used.

The substitution of ethylenic dicarboxylic acid may include vinyl ketones such as vinyl methyl ketones and vinyl esters such as vinyl methyl ethers.

The aforementioned resins may be used alone or in combination to form the core and shell for toner particles.

Cross-linking agents may be added to the compositions of the aforementioned monomers as required. Such cross-linking agents include divinylbenzen, divinyl naphthalene, polyethylene glycol dimethacrylate, 2,2'-bis-(4-methacryloxydiethoxydiphenyl) propane, 2,2'-bis-(4-acryloxydiethoxydiphenyl) propane, diethylene glycol diacrylate, triethylene glycol diacrylate, 1,3-butylenglycol dimethacrylate, 1,6-hexylene glycol dimethacrylate, neopentyl glycol dimethacrylate, dipropylene glycol dimethacrylate, polypropylene glycol dimethacrylate, trimethylolpropane trimethacrylate, trimethylolpropane triacrylate, and tetramethylolmethanetetraacrylate. More than one of these cross-linking agents may be combined as required.

Polymerization initiators used in manufacturing thermal plastic resins as a core material for the toner 12, 2,2-azobis (2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, and other azo- or diazo-based polymerization initiators. These other azo- or diazo-series polymerization initiators include peroxide polymerization initiators such as benzoyl peroxide, methyl ethyl ketone peroxide, isopropyl peroxide carbonate, cumene hydroperoxide, 2,4-dichlorobenzoyl peroxide, lauroyl peroxide, and dicumyl peroxide.

In the present invention, the core for toner 12 contains a coloring agent. The coloring agent may be any conventional dyes and pigments. The coloring agents used in the present invention include carbon black of various types, graft carbon whose surface is covered with a resin, brilliant first scarlet, phtalocyanine blue, nigrosine, pigment green B, rhodamine-B-base, permanent brown FG, and solvent red 49, or mixtures of these materials. The aforementioned various types of carbon black are manufactured by various methods such as acetylene black, thermal black, channel black, and lampblack.

In the embodiment of the present invention, a charge control agent may be added to a core material. Negative charge control agents include metal azo dye such as AIZEN SPILON BLACK THR which is available from HODOGAYA KAGAKU, "BONTRON S-31" (trade name), "BONTRON S-32" (trade name), "BONTRON S-34" (trade name), and VALIFAST BLACK 3804 which are available from ORIENT CHEMICAL INDUSTRIES LTD; quaternary ammonium salts such as COPY CHARGE NX VP434 (available from HOECHST) and nitroimidazole derivatiuls copper phtalocyanine dyes; and metal complexes of alkylated derivatives of salicylic acid such as "BONTRON E-81" (trade name), "BONTRON E-82" (trade name), and "BONTRON E-85" (trade name) which are available from ORIENT CHEMICAL INDUSTRIES LTD.

Also, other charge control agents that are charged negatively may be used.

Charge control agents for positively charging the toner include nigrosine dyes such as OIL BLACK BS, "BONTRON N-01", "BONTRON N-07", "BONTRON N-11", Nigrosine Base EX, OIL BLACK SO, which are all trade names of ORIENT CHEMICAL INDUSTRIES LTD; triphenylmethane based dye stuffs that contain tertiary amine as a side chain; quaternary ammonium compounds such as "BONTRON P-51" (trade name of ORIENT CHEMICAL INDUSTRIES LTD); cetyltrimethylammonium bromide such as COPY CHARGE PX VP435 (available from HOECHST); polyamine resin such as AFP-B (available from ORIENT CHEMICAL INDUSTRIES LTD); and imidazole derivatives. Also, other charge control agents that are charged positively may be used.

In order to efficiently prevent "off-set" of images, the core materials may contain at least any one of the following offset preventing agents. The offset preventing agents include polyolefin, fatty acid metal salts, higher fatty acid, fatty ester, partially saponified fatty acid ester, higher alcohol, paraffin wax, silicone oil, amid-based waxes, silicone varnishes, polyhydric alcohol ester, and fatty acid fluorocarbon.

The aforementioned polyolefins may be resins such as polypropylene, polyethylene, and polybuten. The aforementioned metallic salts of fatty acid includes metallic salts of maleic acid and one of, for example, zinc, magnesium, and calcium; dibasic lead stearate or metallic salts of stearic acid and one of, for example, zinc, cadmium, barium, lead, iron, nickel, cobalt, copper, aluminum, and magnesium; metallic salts of oleic acid and, for example, one of zinc, magnesium, iron, cobalt, copper, lead, and calcium; caprylates or metallic salts of palmitic acid and one of, for example, aluminum and calcium; calcium ricinoleate or the metallic salts of caproic acid/hydrochloric acid/linoleic acid and one of, for example, zinc and cobalt; and metallic salts of recinoleic acid and one of, for example, zinc and cadmium. Further, mixtures of these materials may be used.

The aforementioned fatty esters include, for example, maleic acid ethyl ester, maleic butyl ester, methyl ester stearate, butyl ester stearate, palmitic cetyl ester, and montanic acid ethylene glycol ester. The aforementioned partially saponified fatty acid ester partially saponified fatty acid ester is, for example, partially saponified calcium product of montanic acid ester.

The aforementioned higher fatty acid includes dodecanoic acid, lauric acid, myristic acid, palmitic acid, stearic acid, oleic acid, linolic acid, ricinollic acid, iconsanoic acid, behenic acid, lignoceric acid, selacholeic acid, and mixtures of these. The aforementioned higher alcohol includes dodecyl alcohol, lauril alcohol, myristyl alcohol, palmityl alcohol, and stearyl alcohol.

The aforementioned paraffin waxes includes natural paraffin, natural paraffin, microwax, synthetic paraffin, and chlorinated hydrocarbon. The aforementioned amid-based waxes includes stearamide, oleamid, palmitic amide, lauramide, behenamide, methylene-bis-stearamide, ethylene-bis-stearamide, N,N'-m-xylene bis stearamide, N,N'-m-xylene bis-12-hydroxydistearamide, N,N'-isophthalate bis stearamide, and N,N'-isophthalate bis-12-hydroxystearamide.

The aforementioned silicone varnishes include methyl silicone varnish, and phenyl silicone varnish. The aforementioned polyhydric alcohol ester includes, for example, glycerin stearate, glycerin ricinoleate, glycerol monobehanate, solbitan monostearate, propylene glycol monostearate, solbitan trioleate. The aforementioned fatty acid fluorocarbon include, for example, low-molecular weight compound of polytetrafluoroethylene (PTFE)) and polyhexafluoropropylene.

The toner 12 is manufactured by mixing at least a polymerized monomer of the aforementioned materials, which is a resin as a core material, a polymerization initiator, and a coloring agent. Also, a cross-linking agent, a charge control agent, and a wax etc. may be added to the mixture as required.

The mixture is then dispersed in a dispersion medium for polymerization, thereby forming particles that serves as a core.

The aforementioned dispersion media includes water, methanol, ethanol, propanol, butanol, ethylene glycol, glycerin, acetonitorile, acetone, isopropyl ether, tetrahydrofuran, and dioxane. These dispersion media may be used alone or in combination of more than one of these. A dispersion stabilizer may be used in order to ensure the stable ability of dispersion medium to expedite dispersion of a material.

The dispersion stabilizer may be selected from among the following known types: polyvinyl alcohol, polystyrene sulphonic acid, hydroxymethyl cellulose, hydroxyethyl cellulose, hydroxypropylcellulose (HPC), carboxymethylcellulose sodium (CMC sodium), sodium polyacrylic acid, sodium dedecylbenzensulfonat, sodium tetradecyl sulfate, pentadecyl sodium sulfate, octyl sodium sulfate, allyl-alkyl-polyether sodium sulfate, sodium oleate, sodium laurate, sodium caprate, sodium caprylate, sodium caproate, potassium stearate, calcium oleate, and 3,3-disulfon diphenyl urea4,4-diazo-bis-amino-β-naphthol-sodium disulfonic acid, ortho-carboxybenzene-azo-dimethyaniline, 2,2,5,5-tetramethyl-triphenulmethane-4,4-diazo-bis-β-naphthol-sodium disulfonic acid, tricalcium phosphate, ferric oxide, titanium hydroxide, aluminum hydroxide. These dispersion stabilizers may be used along or in combination.

A dispersion stabilizer is added to the aforementioned mixture as required, thereby obtaining a suspension. The suspension is agitated at a temperature in the range of 50 to 100° C. for polymerization. This suspension is an aqueous suspension of a thermal plastic resin particles (referred to as intermediate particles hereinafter) that contains a coloring agent, and is subjected to polymerization reaction until the suspension is completely polymerized.

During polymerization or after completion of polymerization, another polymerizable monomer is added to the suspension for seed polymerization.

In other words, at least a vinyl polymerizable monomer and a vinyl polymerization initiator are added to the aforementioned aqueous suspension, so that the intermediate particles absorb the vinyl polymerizable monomer and vinyl polymerization initiator, and then the monomer compositions in the intermediate particles are polymerized. The vinyl polymerizable monomer and vinyl polymerization initiator may be added to the intermediate particles directly, or an emulsion of a vinyl polymerizable monomer and a vinyl polymerization initiator) may be added. The emulsion is made by dispersing the vinyl polymerizable monomer and vinyl polymerization initiator together with dispersion stabilizer in water, with a cross-linking agent, a charge control agent, and an offset-preventing agent contained as required.

The vinyl polymerization initiator, cross-linking agent, and dispersion stabilizer used in seed polymerization may be the same as those used in manufacturing the intermediate particles, and an aqueous polymerization initiator may also be used as required to optimize the polymerization conditions of the material as a shell.

Adding the vinyl polymerizable monomer or emulsion causes the monomer to cover the surfaces of the intermediate particles, so that the core particles slightly expand. With this condition, the polymerization of the compositions of the polymerizable monomer that serves as a resin for shell is further performed, so that the seed polymerization is performed to form intermediate particles into core particles. In this manner, the toner 12 is made.

The aforementioned method for manufacturing the toner 12 provides core particles that can be sufficiently fused under low energy. The resulting toner 12 has an average diameter in the range of 3 to 30 μm, fusion characteristic at low temperatures, and resistance to offset that are highly balanced.

Further, a fluidity-adding agent and a cleaning aid may be added to the toner 12 according to the present embodiment as required.

Fluidity-adding agents include silica, alumina, titanium oxide, barium titanate, magnesium titanate, calcium titanate, strontium titanate, Chinese white, silver sand, clay, mica, wollastonite, diatomic earth, chromic oxide, cerium oxide, colorthar, antimony trioxide, magnesium oxide, zirconium dioxide, barium sulfate, barium carbonate, calcium carbonate, silicon carbide, and silicon nitride.

Micronized silica has Si—O—Si bonding and may be manufactured by either of a dry process or a wet process. Also, silicon dioxide anhydride, aluminum silicate, sodium silicate, potassium silicate, magnesium silicate, and zinc silicate may be used. Further, Micronized silica may be used which have been subjected to surface treatment with silane coupling agents, titanium coupling agents, silicone oil, and silicone oil having amine with a side chain.

Cleaning aids include metallic salts of higher fatty acids such as zinc stearate and finely powdered particles of fluoropolymers. Further, finely powdered particles of a polymeric product such as methacryl acid methylester and methacryl acid butylester may be used which are additives for adjusting the ability to develop images.

The toner 12 for fixing purpose under heat and pressure according to the present embodiment is used alone if the toner contains magnetic fine powder. The toner 12 may also be used to provide a two-component developer by mixing with a non-magnetic one-component developer or with a carrier if the toner does not contain magnetic fine powder. The aforementioned carriers include iron powder, ferrite, and glass beads, or these covered with a resin. The carrier may also contain fine powder of magnetite or ferrite fine powder kneaded in a resin. When the toner is mixed with the carrier, the ratio of the toner to the carrier is in the range of 0.5 to 20 weight parts. The carrier particles have an average diameter in the range of 15 to 500 μm.

Table 3 lists the characteristics of toner according to the invention.

TABLE 3

| characteristic | value | measurement method |
|---|---|---|
| Volume resistivity | $10^{11}$ to $10^{12}$ Ωcm | measurement of dielectric loss (30° C., 1 kHz) |
| amount of charge (Q/M) | −60 to −80 μC/g | Blow off (23° C., 50% RH) |
| amount of charge without external additive (Q/M) | −58 to −70 μC/g | |

Roundness is the degree of surface roughness of a spherical toner particle, and is given by the following relation.

Roundness=(peripheral length of a projected area of a particle)/(peripheral length of a projected image of the particle)

"Peripheral length of a projected area of a particle" is a peripheral length of a projected area of a toner particle that has been digitized. "Peripheral length of a projected image of a particle" is the sum of lines that connect adjacent outwardly extending edges of the particle.

Roundness of a particle is measured by using a flow-type particle image-analyzing instrument (e.g., Model FPLA-2000, available from TOA IYO DENSHI).

A perfectly sphere toner particle has a roundness of 1.00. The more complex the tone surface is, the smaller the roundness of the toner is. An average roundness is obtained by dividing the sum of the roundness of 3500 particles by 3500. The toner according to the invention has values of roundness in the range of 0.97 to 0.99. Values of roundness greater than 0.93 are adequate.

{Examples of Toner}

The following materials were added to a blend of 77.5 weight parts of styrene and 22.5 weight parts of acrylic acid-n-butyl: 1.5 weight parts of low molecular weight polyethylene that serves as an offset preventing agent; 1.0 weight part of AIZEN SPILON BLACK THR (available from Hodogaya Kagaku) that serves as a charging controlling agent; 7.0 weight parts of carbon black "PRINTEX L (available from Degussa Corporation), and 1.0 weight parts of 2,2'- azobisiobutyronitrile.

Then, the mixture was introduced into a pulverizer ("MA-01SC" available from Mitsui-Miike Kakoki) and dispersed at 15° C. for 10 hours to obtain a polymerized composition.

Further, 180 weight parts of ethanol was prepared in which 8.0 weight parts of polyacrylic acid and 0.35 weight part of divinylbenzene were melted. The thus prepared ethanol was then added to 600 weight parts of distilled water, thereby preparing a dispersion medium for polymerization.

The polymerization composition was added to this dispersion medium and dispersed in the Model "M" TK HOMO-MIXER (available from TOKUSHU KIKA KOGYO CO., LTD.) at 15° C. for 10 minutes under 8,000 revolutions.

Then, the thus obtained dispersion medium was put into a separable flask of a 1-liter capacity and subjected to reaction at 85° C. for 12 hours with agitation at 100 r.p.m. in the flow of nitrogen gas. The dispersoid obtained through polymerization reaction of the polymerization composition at this stage is referred to as intermediate particles.

Then, using Model US-150 ultrasonic transmitter (available from NIPPON SEIKI), emulsion A was prepared by mixing in the aqueous suspension of this intermediate particles with the following materials: 9.25 weight parts of methyl methacrylate, 0.75 weight parts of acrylic acid-n-butyl, and 0.5 weight parts of 2,2'-azobisisobutyronitrile, 0.1 weight parts of sodium lauryl sulphate, and 80 weight parts of water.

Then, the thus prepared emulsion A by 9 weight parts of was dropped on the intermediate particles so that the intermediate particles swelled. Immediately after dropping the emulsion A, the intermediate particles were observed under an optical microscope. No drip of emulsion was observed. This indicated that swelling had completed in a very short time.

The material was then subjected to the second stage of polymerization at 85° C. for 10 hours with agitation in a nitrogen atmosphere. After cooling the material, the dispersion medium was melted in a 0.5 n aqueous solution of hydrochloric acid, and then filtered. Thereafter, the material was washed in water and dried in wind. Then, the material was further dried in an atmosphere of 10 mm Hg at 40° C. for 10 hours. Then, the material was classified with a pneumatic separator, thereby providing capsule toner particles having an average diameter of 7 μm.

A mixture of 0.5 weight parts of cleaning aid R and 50 weight parts of capsule toner was made, thereby obtaining the toner 12 according to the invention. The thus made toner 12 in an amount of 30 grams was agitated for 30 seconds, and then ten minutes later, the apparent saturated volume of the toner was calculated based on the volume measured with a graduated cylinder. The saturated apparent density was 0.4138 g/ml.

Table 4 shows a total of seven different toners, i.e., Comparison toners #1 to #3 and Example toners #1 to #4 prepared for different combinations of the type and amount of cleaning aid.

TABLE 4

| | Comparison toners | | | Example toners | | | |
|---|---|---|---|---|---|---|---|
| parameters | #1 | #2 | #3 | #1 | #2 | #3 | #4 |
| type of agent | — | J | J | R | R | L | R |
| amount of agent | 0.0 | 0.3 | 0.5 | 0.3 | 0.5 | 0.1 | 0.1 |
| saturated apparent density (g/ml) | 0.4478 | 0.4412 | 0.4380 | 0.4217 | 0.4138 | 0.4110 | 0.3750 |

The toner 12 in an amount of 30 grams was agitated for 30 seconds, and placed in a 100-ml graduated cylinder. Then, the saturated apparent volume of the toner was calculated based on the volume of the toner ten minutes after the toner was introduced into the 100-ml graduated cylinder.

Using the Comparison toners #1 to #3 and Example toners #1 to #4, intermittent printing of a total of 300 pages was performed with a five minute-interval between consecutive pages. The printing was performed in an environment of 10° C. and 20% RH in a low-duty mode. Table 5 lists the results.

Printing in a low-temperature and low-humidity environment tends to cause soiling of printed images. If soiling of printed images does not occur after having printed on a total of 300 pages at 5-min. intervals in a low-duty mode at 10° C. and 20% RH, a printer can be said reliable.

TABLE 5

| | Comparison toners | | | Example toners | | | |
|---|---|---|---|---|---|---|---|
| parameters | #1 | #2 | #3 | #1 | #2 | #3 | #4 |
| saturated apparent density (g/ml)type of agent | 0.4478 | 0.4412 | 0.4380 | 0.4217 | 0.4138 | 0.4110 | 0.3750 |
| soiling | Y | Y | Y | N | N | N | N |

The symbol Y denotes occurrence of soiling and the symbol N denotes non-occurrence of soiling. Table 5 implies that a saturated apparent density of not more than 0.4217 g/ml will not cause soiling of printed images.

SECOND EMBODIMENT

An electrophotographic printer of the same construction as the first embodiment was used. A voltage of −220 V was applied to the developing roller 14. Table 6 lists the voltages applied to the sponge roller 13 and the amount of toner deposited to the developing roller 14.

TABLE 6

| | voltage applied to sponge roller (V) | | |
|---|---|---|---|
| | −400 | −520 | −620 |
| toner on developing roller ($mg/cm^2$) | 0.5 | 0.8 | 1.0 |

Amounts of deposited toner less than 0.5 $mg/cm^2$ fail to provide sufficient image quality. Amounts of toner more than 1.0 $mg/cm^2$ cause excessive deposition of the toner 12 on the paper 23, resulting in almost solid black images when halftone images are printed. For this fact, the voltage applied to the sponge roller 13 should be in the range of −400 to −620 V.

Thus, for good image quality in an electrophotographic printer shown in FIG. 1, the amount of toner deposited on the developing roller 14 should be in the range of 0.5 to 1.0 $mg/cm^2$, preferably in the range of 0.6 to 0.9 $mg/cm^2$. That is, printing was performed by using Example toners #1 to #4 with the amount of toner in the range of 0.6 to 0.9 $mg/cm^2$ deposited on the developing roller 14, thereby examining the print results to determine whether soiling of images appears. The results similar to those of the first embodiment were obtained.

In other words, when the amount of toner deposited on the developing roller 14 is in the range of 0.5 to 1.0 $mg/cm^2$, the toner 12 having a saturated apparent density of not more than 0.4217 g/ml will not cause soiling of images after intermittent low duty printing in a low-temperature and low-humidity environment, but provides good image quality.

THIRD EMBODIMENT

An electrophotographic printer of the same construction as the first embodiment was used. Image quality was evaluated by performing printing for different ratios γ of the rotational speed V2 of the sponge roller 13 to that V1 of the developing roller 14 as listed in Table 7, ratio γ being given by γ=N2/V1. Also, the surface potential Et of the toner layer formed on the developing roller 14 was selected to be in the range of −50 to −250 V.

TABLE 7

| | pressure applied by developing blade (gf) | | |
|---|---|---|---|
| | 480 | 530 | 580 |
| ratioγ | 0.441 | 0.497 | 0.543 |
| potential Et (V) | −50 | −150 | −250 |

The evaluation revealed that the surface potential Et should be in the range of−50 to −250 V and preferably in the range of −100 to −200 for good image quality when using the electrophotographic printer shown in FIG. 1. That is, printing was performed by using Example toners #1 to #4 with the surface potential Et in the range of −50 to −250 V, thereby examining the print results to determine whether soiling of images appears. The results were as good as those of the first embodiment.

In other words, when the surface potential Et of the toner layer formed on the developing roller 14 is in the range of −50 to −250 V, the toner 12 having a saturated apparent density of not more than 0.4217 g/ml will not cause soiling of images after intermittent low-duty printing in a low-temperature and low-humidity environment, but provides good image quality.

FOURTH EMBODIMENT

An electrophotographic printer of the same construction as the first embodiment was used. Image quality was evaluated by performing solid-black printing for different combinations of voltage applied to the developing roller 14 and the amount of toner deposited on the photoconductive drum as listed in Table 8.

TABLE 8

| | voltage applied to sponge roller (V) | | |
|---|---|---|---|
| | −170 | −220 | −270 |
| toner deposited on drum ($mg/cm^2$) | 0.4 | 0.6 | 0.8 |

Deposition of toner not more than 0.4 $mg/cm^2$ will not provide adequate quality of image. Conversely, toner deposition more than 0.8 $mg/cm^2$ will cause excessive toner deposition on the paper 23, so that halftone images are almost solid black. Thus, the amount of toner deposited on the photoconductive drum 21 should be in the range of 0.4 to 0.8 $mg/cm^2$, preferably in the range of 0.5 to $0.7/cm^2$. That is, printing was performed by using Example toners #1 to #4 with the amount of toner deposited on the developing roller 14 in the range of 0.4 to 0.8 $mg/cm^2$, thereby examining the print results to determine whether soiling of images appears. The results were as good as those of the first embodiment.

The aforementioned embodiments have been described with respect to intermittent low-duty printing. Also, when continuous low-duty printing was performed, no disturbance was observed in the printed images and good print quality was obtained.

The toner 12 used in the aforementioned embodiments are capsule type toner 12. Toners of other structures may also be used provided that the toner particles are substantially spherical.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A toner comprising spherical toner particles wherein the toner has a saturated apparent density of not more than 0.4217 g/ml, such that soiling of a printed image is not caused, the toner being chargeable to a negative polarity.

2. A toner cartridge comprising the toner according to claim 1.

3. The toner according to claim 1, wherein the saturated apparent density is in a range of 0.375 to 0.4217 g/ml.

4. A toner cartridge comprising the toner according to claim 3.

5. The toner according to claim 1, wherein the toner is a non-magnetic one-component toner.

6. A toner cartridge comprising the toner according to claim 5.

7. The toner according to claim 1, wherein the toner is a two-component toner.

8. A toner cartridge comprising the toner according to claim 7.

9. The toner according to claim 7 wherein the toner is mixed with a carrier, a ratio of the toner to the carrier is in a range of 0.5 weight parts to 20 weight parts, the carrier particles having an average diameter in a range of 15 μm to about 500 μm.

10. A toner cartridge comprising the toner according to claim 9.

11. The toner according to claim 1, wherein the toner has an average diameter of in arange of 3 μm to 30 μm.

12. A toner cartridge comprising the toner according to claim 11.

13. The toner according to claim 1, wherein the toner is formed of a plurality of types of resins that have different glass points.

14. A toner cartridge comprising the toner according to claim 13.

15. The toner according to claim 1, wherein the saturated apparent density is a value determined by the steps of:

agitating an amount of toner for an amount of time;

putting the agitated toner in a container;

leaving the agitated toner in the container for a predetermined amount of time, in the absence of mechanical vibration; and measuring a ratio of a weight of the toner in the container to a volume of the toner in the container.

16. A toner cartridge comprising the toner according to claim 15.

* * * * *